US011193717B2

(12) United States Patent
Kiso

(10) Patent No.: US 11,193,717 B2
(45) Date of Patent: Dec. 7, 2021

(54) LOOP HEAT PIPE

(71) Applicant: Shinko Electric Industries Co., LTD., Nagano-Ken (JP)

(72) Inventor: Takahiko Kiso, Nagano (JP)

(73) Assignee: Shinko Electric Industries Co., LTD., Nagano-ken (JP)

( * ) Notice: Subject to any disclaimer, the term of this patent is extended or adjusted under 35 U.S.C. 154(b) by 41 days.

(21) Appl. No.: 16/245,392

(22) Filed: Jan. 11, 2019

(65) Prior Publication Data

US 2019/0234692 A1 Aug. 1, 2019

(30) Foreign Application Priority Data

Jan. 30, 2018 (JP) ..... JP2018-014058

(51) Int. Cl.

| | |
|---|---|
| ***F28D 15/04*** | (2006.01) |
| ***F28D 15/02*** | (2006.01) |
| ***F28D 21/00*** | (2006.01) |
| ***F28F 3/08*** | (2006.01) |

(52) U.S. Cl.

CPC ..... *F28D 15/043* (2013.01); *F28D 15/0233* (2013.01); *F28D 15/0266* (2013.01); *F28D 15/0283* (2013.01); *F28D 2021/0028* (2013.01); *F28F 3/086* (2013.01)

(58) Field of Classification Search

CPC ..... F28D 15/00; F28D 15/02; F28D 15/0233; F28D 15/0266; F28D 15/0283; F28D 2021/0028; F28D 15/043; F28F 3/086; F28F 13/12

See application file for complete search history.

(56) References Cited

U.S. PATENT DOCUMENTS

| | | | | |
|---|---|---|---|---|
| 7,051,793 | B1 * | 5/2006 | Schulz-Harder | F28D 15/0233 165/104.26 |
| 10,517,192 | B2 * | 12/2019 | Hsiao | F28D 15/0233 |
| 2003/0159809 | A1 * | 8/2003 | Valenzuela | F28D 15/0233 165/104.26 |
| 2003/0192669 | A1 * | 10/2003 | Wu | F28D 15/0241 165/46 |
| 2005/0022978 | A1 * | 2/2005 | Duval | F28D 15/0233 165/104.26 |

(Continued)

FOREIGN PATENT DOCUMENTS

| | | | |
|---|---|---|---|
| JP | 2002-022381 A | | 1/2002 |
| JP | 2016142416 A | * | 8/2016 |
| WO | 2015/087451 A1 | | 6/2015 |

OTHER PUBLICATIONS

JP2016142416A Machine Translation (Year: 2016).*

*Primary Examiner* — Len Tran
*Assistant Examiner* — Gustavo A Hincapie Serna
(74) *Attorney, Agent, or Firm* — Wolf, Greenfield & Sacks, P.C.

(57) ABSTRACT

A loop heat pipe includes a metal layer stack of two outermost metal layers and intermediate metal layers stacked between the two outermost metal layers. The metal layer stack includes an evaporator, a condenser, a vapor pipe, a liquid pipe, and an inlet. The metal layer stack forms a flow passage that circulates the working fluid through the evaporator, the vapor pipe, the condenser, and the liquid pipe. At least one of the two outermost metal layers includes a thin wall portion that forms a portion of a wall of the vapor pipe in the flow passage.

20 Claims, 9 Drawing Sheets

(56) References Cited

U.S. PATENT DOCUMENTS

| | | | | |
|---|---|---|---|---|
| 2006/0098411 | A1* | 5/2006 | Lee | F28D 15/046 361/704 |
| 2009/0040726 | A1* | 2/2009 | Hoffman | F28D 15/0233 361/700 |
| 2010/0008043 | A1* | 1/2010 | Yajima | F28D 15/0233 361/700 |
| 2012/0106084 | A1* | 5/2012 | Mizuta | F28D 15/046 361/700 |
| 2012/0145358 | A1* | 6/2012 | Moon | F28D 15/046 165/104.26 |
| 2013/0269913 | A1* | 10/2013 | Ueda | F28D 15/04 165/104.26 |
| 2013/0308272 | A1* | 11/2013 | Furuta | F28D 15/04 361/700 |
| 2015/0119111 | A1* | 4/2015 | Honmura | H04M 1/026 455/566 |
| 2016/0259383 | A1* | 9/2016 | Shioga | G06F 1/203 |
| 2018/0058767 | A1* | 3/2018 | Machida | H01L 23/427 |
| 2019/0128618 | A1* | 5/2019 | Machida | G06F 1/203 |
| 2019/0316848 | A1* | 10/2019 | Tseng | F28D 15/046 |
| 2019/0331432 | A1* | 10/2019 | Tseng | F28D 15/0275 |
| 2019/0335619 | A1* | 10/2019 | Tseng | H01L 23/427 |
| 2020/0080791 | A1* | 3/2020 | Yokoyama | F28D 15/0233 |

* cited by examiner

LOOP HEAT PIPE

CROSS-REFERENCE TO RELATED APPLICATIONS

This application is based upon and claims the benefit of priority from prior Japanese Patent Application No. 2018-014058, filed on Jan. 30, 2018, the entire contents of which are incorporated herein by reference.

FIELD

This disclosure relates to a loop heat pipe and a method for manufacturing a loop heat pipe.

BACKGROUND

A heat pipe is a device that uses phase transition of a working fluid to cool heat-generating components of a semiconductor device, such as a central processing unit (CPU), mounted on an electronic device (refer to International Patent Publication No. 2015/087451 and Japanese Laid-Open Patent Publication No. 2002-22381).

SUMMARY

A heat pipe includes an evaporator (heat generator) arranged to be in contact with a heat-generating component of an electronic device and a condenser (heat dissipater). When mounting a heat pipe on an electronic device, the evaporator and the condenser may not be located on the same plane. In such a case, the heat pipe needs to be bent. However, such bending may narrow or close the flow passage of the working fluid and hinder the flow of the working fluid. When the flow of the working fluid is hindered in such a manner, the heat pipe may fail to function properly.

One embodiment is a loop heat pipe including a metal layer stack of two outermost metal layers and a plurality of intermediate metal layers stacked between the two outermost metal layers. The metal layer stack includes an evaporator that vaporizes working fluid, a condenser that liquefies the working fluid vaporized by the evaporator, a vapor pipe that sends the working fluid vaporized by the evaporator to the condenser, a liquid pipe that sends the working fluid liquefied by the condenser to the evaporator, and an inlet that fills the loop heat pipe with the working fluid. The metal layer stack forms a flow passage that circulates the working fluid through the evaporator, the vapor pipe, the condenser, and the liquid pipe. At least one of the two outermost metal layers includes a thin wall portion that forms a portion of a wall of the vapor pipe in the flow passage.

A further embodiment is a method for manufacturing a loop heat pipe. The method includes forming a metal layer stack by stacking a plurality of intermediate metal layers between two outermost metal layers. The metal layer stack includes an evaporator that vaporizes working fluid, a condenser that liquefies the working fluid vaporized by the evaporator, a vapor pipe that sends the working fluid vaporized by the evaporator to the condenser, a liquid pipe that sends the working fluid liquefied by the condenser to the evaporator, and an inlet that fills the loop heat pipe with the working fluid. At least one of the two outermost metal layers includes a thin wall portion that forms a portion of a wall of the vapor pipe. The method further includes bending the loop heat pipe at a position of the thin wall portion with the thin wall portion arranged at an outer side, expanding the thin wall portion toward an outside of the wall of the vapor pipe by filling the loop heat pipe with compressed air from the inlet and applying internal pressure to the thin wall portion, and hermetically sealing the inlet after filling the loop heat pipe with the working fluid from the inlet.

Other embodiments and advantages thereof will become apparent from the following description, taken in conjunction with the accompanying drawings, illustrating by way of example the principles of the invention.

It is to be understood that both the foregoing general description and the following detailed description are exemplary and explanatory and are not restrictive of the invention, as claimed.

BRIEF DESCRIPTION OF THE DRAWINGS

The embodiments, together with objects and advantages thereof, may best be understood by reference to the following description of the presently preferred embodiments together with the accompanying drawings in which.

DESCRIPTION OF THE EMBODIMENTS

Figure 1:
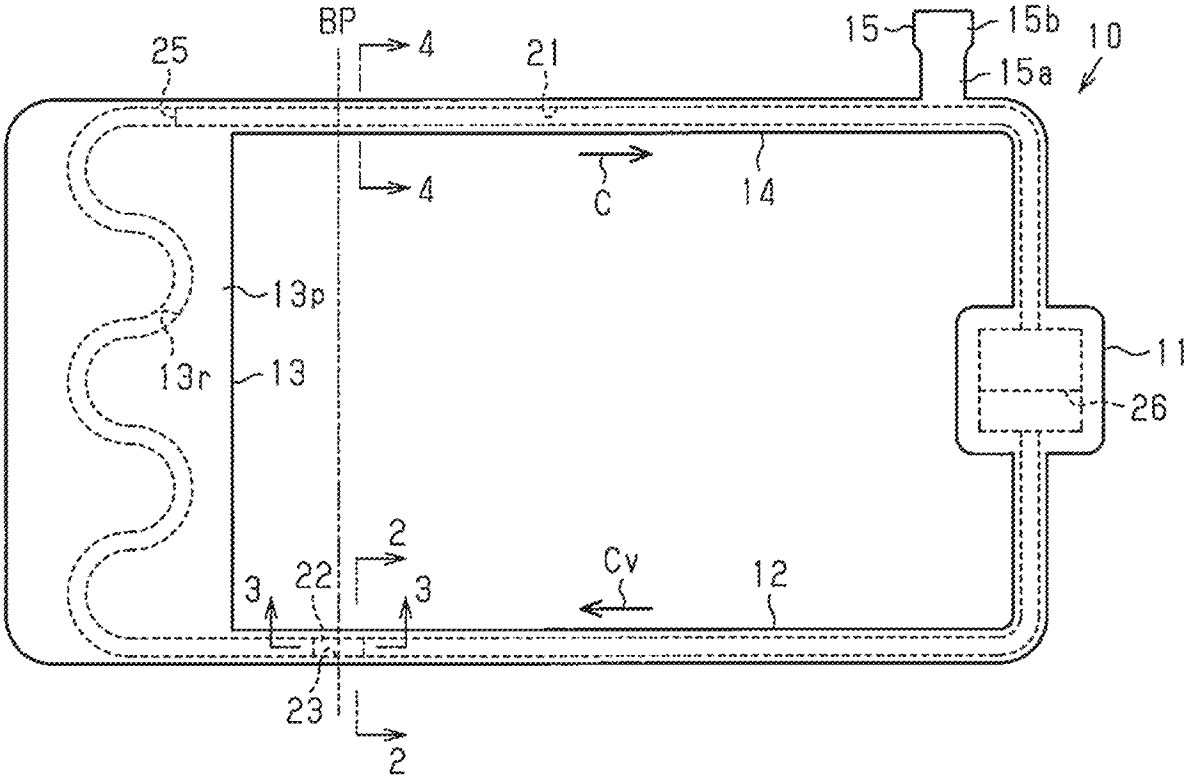
FIG. 1 is a schematic plan view of a loop heat pipe according to an exemplary embodiment.

One embodiment will now be described with reference to the drawings. In the drawings, elements are illustrated for simplicity and clarity and have not necessarily been drawn to scale. To facilitate understanding, hatching lines may not be illustrated in the plan views and the cross-sectional views.

As illustrated in FIG. 1, a loop heat pipe 10 includes an evaporator 11, a vapor pipe 12, a condenser 13, a liquid pipe 14, and an inlet 15. The evaporator 11 is connected by the vapor pipe 12 to the condenser 13. The condenser 13 is connected by the liquid pipe 14 to the evaporator 11. The evaporator 11 is configured to vaporize working fluid C and generate vapor Cv. The vapor pipe 12 is configured to send the vapor Cv of the working fluid C to the condenser 13. The condenser 13 is configured to liquefy the vapor Cv of the working fluid C. The liquid pipe 14 is configured to send the liquefied working fluid C to the evaporator 11. The evaporator 11, the vapor pipe 12, the condenser 13, and the liquid pipe 14 form a looped flow passage 21 through which liquefied working fluid C or the vapor Cv flows. In the present embodiment, the liquid pipe 14 has the same length as, for example, the vapor pipe 12. However, the length of the liquid pipe 14 may differ from the length of the vapor pipe 12. For example, the vapor pipe 12 may be shorter than the liquid pipe 14.

Figure 7:
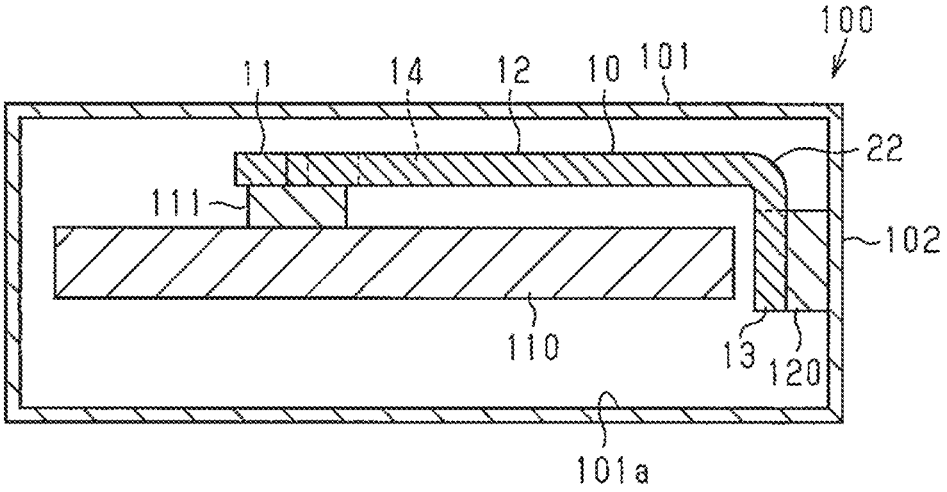
FIG. 7 is a schematic cross-sectional view of an electronic device including the loop heat pipe of FIG. 1.

The evaporator 11 is fixed to a heat-generating component 111 illustrated in FIG. 7 in contact with the heat-generating component 111. The evaporator 11 uses the heat generated by the heat-generating component 111 to vaporize the working fluid C and generate the vapor Cv. Although not illustrated in the drawings, thermal interface material (TIM) may be arranged between the evaporator 11 and the heat-generating component 111. The thermal interface material reduces thermal contact resistance between the heat-generating component 111 and the evaporator 11 and smoothly transfers heat from the heat-generating component 111 to the evaporator 11. The vapor Cv generated by the evaporator 11 is guided via the vapor pipe 12 to the condenser 13.

The condenser 13 includes a heat dissipation plate 13*p*, which has a large area to dissipate heat, and a flow passage 13*r*, which meanders through the heat dissipation plate 13*p*. The condenser 13 liquefies the vapor Cv drawn through the vapor pipe 12. The working fluid C liquefied by the condenser 13 is guided via the liquid pipe 14 to the evaporator 11.

The loop heat pipe 10 moves the heat generated by the heat-generating component 111 illustrated in FIG. 7 from the evaporator 11 to the condenser 13 so that the condenser 13 dissipates heat. In this manner, the loop heat pipe 10 cools the heat-generating component 111 by circulating the working fluid C in the flow passage 21.

Preferably, fluid having a high vapor pressure and a high latent heat of vaporization is used as the working fluid C. The use of such a working fluid C efficiently cools the heat-generating component with the latent heat of vaporization. Examples of the working fluid C include ammonia, water, chlorofluorocarbon, alcohol, and acetone.

The inlet 15 is configured to fill the loop heat pipe 10 with the working fluid C. In the present embodiment, the inlet 15 is connected to the liquid pipe 14. The inlet 15 is hermetically sealed after filling the loop heat pipe 10 with the working fluid C. The inlet 15 may be connected to the condenser 13, the vapor pipe 12, or the evaporator 11. In such a case, the working fluid C is moved from the inlet 15 into the liquid pipe 14.

In the present embodiment, the inlet 15 includes a non-sealed portion 15*a* coupled to the liquid pipe 14 and a sealed portion 15*b* coupled to the non-sealed portion 15*a*. The shape of the non-sealed portion 15*a* is substantially the same as the shape prior to sealing, that is, the shape when filling the liquid pipe 14 with the working fluid C. The shape of the sealed portion 15*b* is substantially the same as the shape of the non-sealed portion 15*a* when filling the liquid pipe 14 with the working fluid C. After the liquid pipe 14 is filled with the working fluid C, the sealed portion 15*b* is squeezed and flattened. The flattening of the sealed portion 15*b* hermetically seals the sealed portion 15*b* so that the working fluid C does not flow out of the liquid pipe 14.

Further, the inlet 15 is used to fill the loop heat pipe 10 with compressed air. In other words, compressed air is used to apply pressure (internal pressure) to the inside of the loop heat pipe 10, namely, the flow passage 21. Pressure is applied to the inside of the loop heat pipe 10 so that the working fluid C (vapor Cv) smoothly flows in the flow passage 21 after bending the loop heat pipe 10. The structure of the flow passage 21 will now be described.

The loop heat pipe 10 may be formed by stacking a plurality of metal layers. In a non-restrictive example, the loop heat pipe 10 is formed by a metal layer stack of six metal layers 41 to 46 (refer to FIGS. 2A and 3 to 5C). The metal layer stack of the metal layers 41 to 46 includes the evaporator 11, the vapor pipe 12, the condenser 13, the liquid pipe 14, and the inlet 15. The metal layers 41 to 46 are, for example, copper layers having superior thermal conductance and directly bonded with each other through solid-phase bonding or the like. The metal layers 41 to 46 may each have a thickness of, for example, 50 μm to 200 μm. The metal layers 41 to 46 are not limited to copper layers and may be stainless layers, aluminum layers, magnesium alloy layers, or the like. There is particularly no limit to the number of the stacked metal layers. One or more of the metal layers 41 to 46 may be formed from a material that differs from that of the other metal layers.

The loop heat pipe 10 is bent at, for example, position BP indicated by the double-dashed lines in FIG. 1. In the present embodiment, the bending position BP is set in the liquid pipe 14 and the vapor pipe 12.

Figure 2A:
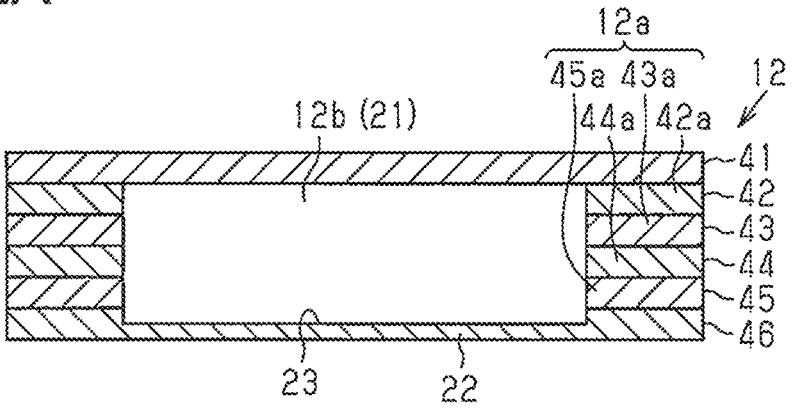
FIG. 2A is a cross-sectional view taken along line 2-2 in FIG. 1 illustrating an evaporator of the loop heat pipe.
Figure 3:
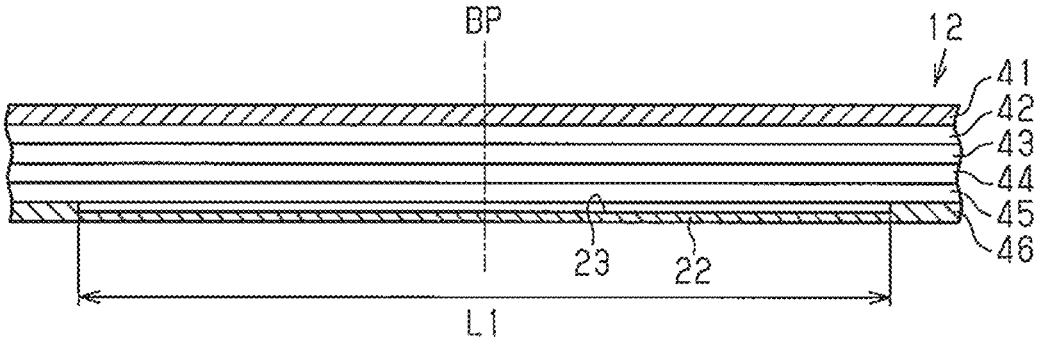
FIG. 3 is a cross-sectional view taken along line 3-3 in FIG. 1 illustrating a vapor pipe.

As illustrated in FIG. 1, the vapor pipe 12 includes a thin wall portion 22 at the bending position BP. FIGS. 2A and 3 illustrate the cross-sections of the liquid pipe 14 of the loop heat pipe 10. FIG. 2A is a cross-sectional view taken along line 2-2 in FIG. 1, and FIG. 3 is a cross-sectional view taken along line 3-3 in FIG. 1.

As illustrated in FIGS. 2A and 3, the vapor pipe 12 is formed by, for example, a metal layer stack of the metal layers 41 to 46. In the description hereafter, the metal layer 41 may also be referred to as the outermost metal layer 41 (or the uppermost metal layer 41), the metal layer 46 may be referred to as the outermost metal layer 46 (or the lowermost metal layer 46), and the metal layers 42 to 45 may be referred to as the intermediate metal layers 42 to 45. When there is no need to distinguish the outermost metal layers from the intermediate metal layers, these metal layers will simply be referred to as the metal layers 41 to 46. In FIGS. 2A and 3, the metal layers 41 to 46 are distinguished from one another by solid lines and indicated by different hatching lines. However, when integrating the metal layers 41 to 46 through, for example, diffusion bonding, the interfaces of the metal layers 41 to 46 may be eliminated, and the boundaries of the metal layers 41 to 46 may not be clear.

The outermost metal layers 41 and 46 are located at the outermost sides of the metal layer stack including the metal layers 41 to 46. The intermediate metal layers 42 to 45 are located between the outermost metal layer 41 and the outermost metal layer 46. Accordingly, the loop heat pipe 10, which includes the vapor pipe 12, is formed by the two outermost metal layers 41 and 46 and the four intermediate metal layers 42 to 45 stacked between the outermost metal layers 41 and 46. The outermost metal layer 41 is solid and free from holes and pits. The intermediate metal layers 42 to 45 respectively include walls 42*a*, 43*a*, 44*a*, and 45*a* that form a pipe wall 12*a* of the vapor pipe 12.

Figure 2B:
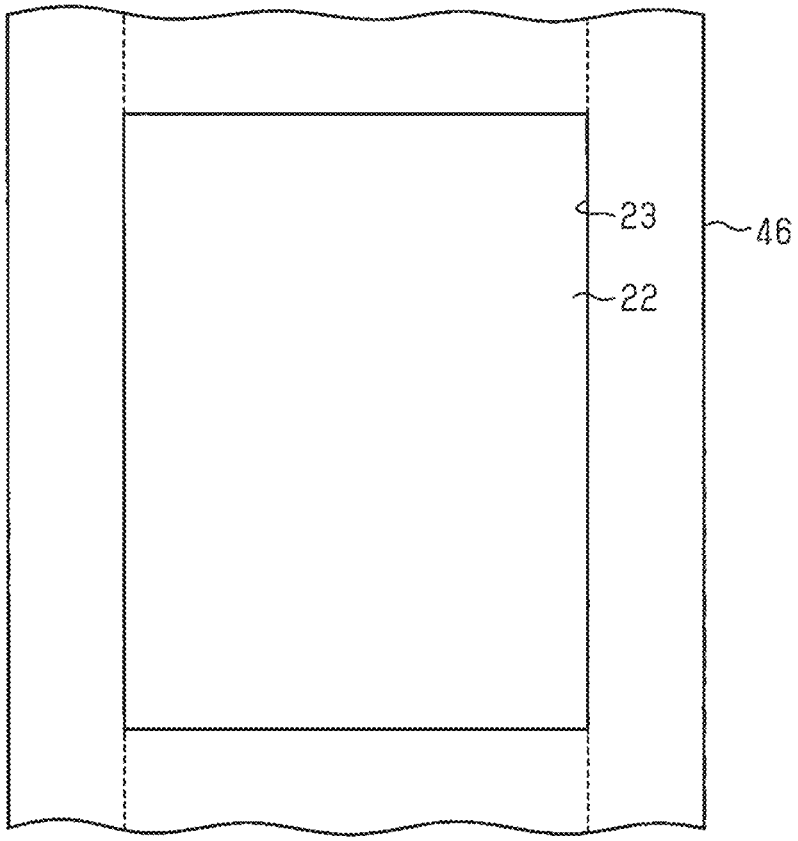
FIG. 2B is a partial plan view of a metal layer including a thin wall portion (recess)

As illustrated in FIGS. 2A and 2B, the outermost metal layer 46 includes the thin wall portion 22. The thin wall portion 22 is formed by a recess 23 that is hollowed from the upper surface of the outermost metal layer 46. Accordingly, the bottom surface of the vapor pipe 12 is defined by the upper surface of the thin wall portion 22 where the recess 23 is formed and by the upper surface of the outermost metal layer 46 where the recess 23 is not formed. As illustrated in FIG. 2A, the recess 23 is located in the flow passage 21 (flow passage 12*b* of vapor pipe 12) defined by the walls 42*a* to 45*a* of the intermediate metal layers 42 to 45. In other words, the walls 42*a* to 45*a* illustrated in FIG. 2A are located outward (toward left and right sides as viewed in FIG. 2B) from the broken lines in FIG. 2B. Accordingly, the thin wall portion 22 is not overlapped with the walls 42*a* to 45*a* of the intermediate metal layers 42 to 45 in a plan view (view of vapor pipe 12 in FIG. 2A taken in vertical direction).

As illustrated in FIG. 3, the thin wall portion 22 (recess 23) is formed over a given range L1 in the direction in which the vapor Cv illustrated in FIG. 1 flows (sideward direction as viewed in FIG. 3). The bending position BP is set at the middle of the thin wall portion 22 (recess 23) with respect to the flow direction of the vapor Cv. The range L1 in which the thin wall portion 22 (recess 23) is formed is set, for example, in accordance with the amount the loop heat pipe 10 is bent (radius of loop heat pipe 10 at bending position BP). For example, the inner radius of the loop heat pipe 10 at the bent portion may be set to 2.5 mm. In this case, the thin wall portion 22 (recess 23) may be formed over the range L1 of, for example, 5 to 10 mm.

As illustrated in FIG. 1, the liquid pipe 14 includes a porous body 25. The porous body 25 extends along the liquid pipe 14 to the vicinity of the evaporator 11.

Figure 4:
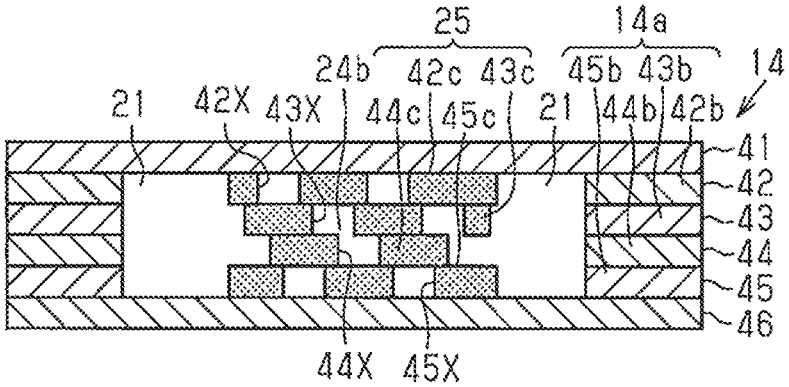
FIG. 4 is a cross-sectional view taken along line 4-4 in FIG. 1 illustrating a liquid pipe of the loop heat pipe.

FIG. 4 is a cross-sectional view taken along line 4-4 in FIG. 1. As illustrated in FIG. 4, the porous body 25 of the liquid pipe 14 is formed by, for example, the intermediate metal layers 42 to 45 between the uppermost metal layer 41 and the lowermost metal layer 46. In FIG. 4, portions of the metal layers 42 to 45 forming the porous body 25 are shaded. In the same manner as FIGS. 2A and 3, the metal layers 41 to 46 are distinguished from one another by solid lines in FIG. 4. However, when integrating the metal layers 41 to 46 through, for example, diffusion bonding, the interfaces of the metal layers 41 to 46 may be eliminated, and the boundaries of the metal layers 41 to 46 may not be clear.

The intermediate metal layers 42 to 45 respectively include walls 42*b*, 43*b*, 44*b*, and 45*b* that form a pipe wall 14*a* of the liquid pipe 14. Further, the walls 42*b* to 45*b* respectively include porous portions 42*c*, 43*c*, 44*c*, and 45*c* that are arranged inside the flow passage 21 defined by the intermediate metal layers 42 to 45. The porous body 25 is formed by a stack of the porous portions 42*c* to 45*c*. The stack of the porous portions 42*c* to 45*c* includes pores 42*x*, 43X, 44X, and 45X. Each of the pores 42X to 45X is, for example, circular in a plan view. The pores 42X to 45X are arranged so as to be partially overlapped with other pores in a metal layer that is adjacent in the vertical direction. The pores 42X to 45X form a fine flow passage 24*b* through which the working fluid C flows. The flow passage 24*b* produces capillary force so that the working fluid C easily flows through the liquid pipe 14.

As illustrated in FIG. 1, the evaporator 11 includes a porous body 26. The porous body 26 has, for example, a structure similar to that of the porous body 25 of the liquid pipe 14.

A method for manufacturing the loop heat pipe 10 will now be described.

Figure 5A:
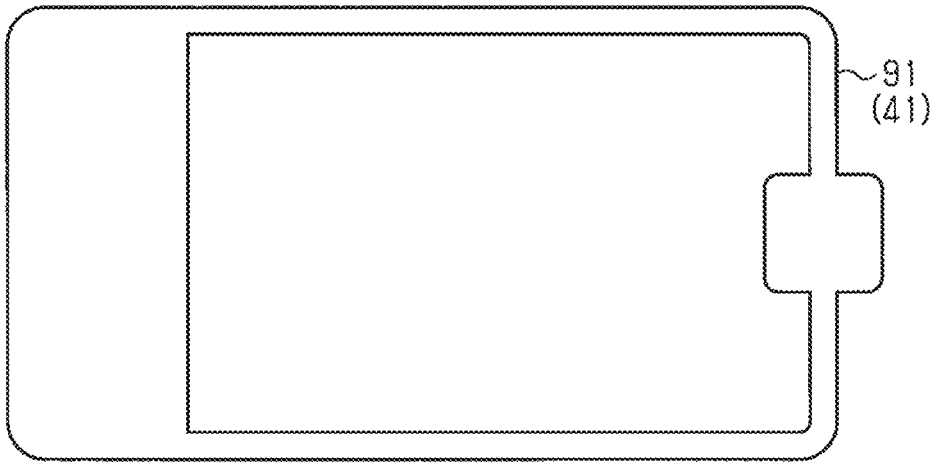
FIG. 5A is a schematic plan view illustrating a first one of a plurality of metal layers of the loop heat pipe.
Figure 5B:
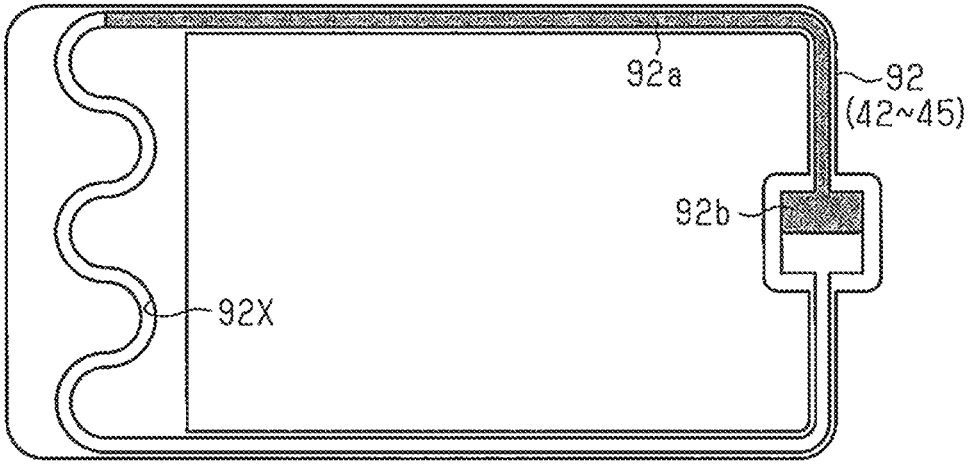
FIG. 5B is a schematic plan view illustrating each of the second to fifth ones of the plurality of metal layers.
Figure 5C:
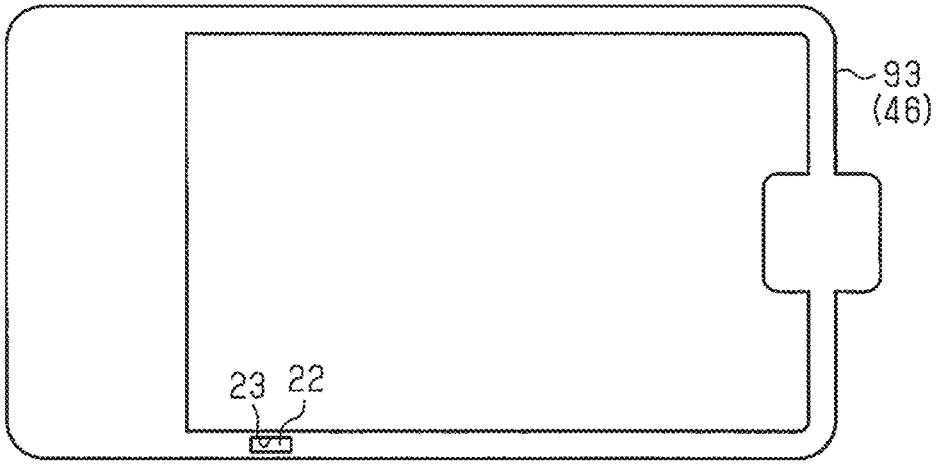
FIG. 5C is a schematic plan view illustrating a sixth one of the plurality of metal layers.

FIGS. 5A to 5C are plan views of metal layers 91 to 93 used in the loop heat pipe 10. FIG. 5A illustrates the metal layer 91 used as the uppermost metal layer 41 in the loop heat pipe 10 (refer to FIGS. 2A, 3, and 4). FIG. 5B illustrates the metal layer 92 used as each of the intermediate metal layers 42 to 45 in the loop heat pipe 10 (refer to FIGS. 2A, 3, and 4). FIG. 5C illustrates the metal layer 93 used as the lowermost metal layer 46 in the loop heat pipe 10 (refer to FIGS. 2A, 3, and 4).

Referring to FIGS. 5A to 5C, the metal layers 91 to 93 are formed by, for example, patterning a copper layer having a thickness of 100 μm into a given shape by performing wet etching.

As illustrated in FIG. 5B, the metal layer 92 includes an opening 92X formed in correspondence with the flow passage 21 that includes the evaporator 11, the vapor pipe 12, the condenser 13, and the liquid pipe 14. Further, a porous portion 92*a* is formed in the metal layer 92 at a portion corresponding to the liquid pipe 14, and a porous portion 92*b* is formed in the metal layer 92 at a portion corresponding to the evaporator 11. The porous portions 92*a* and 92*b* correspond to the porous bodies 25 and 26 described above and include the pores 42X, 43X, 44X, and 45X (refer to FIG. 4). As illustrated in FIG. 5C, the thin wall portion 22 (recess 23) is formed in the metal layer 93 at a portion corresponding to the vapor pipe 12. The thin wall portion 22 (recess 23) may be formed by, for example, wet etching the metal layer 93.

Then, the metal layer 91 (uppermost metal layer 41) illustrated in FIG. 5A, four of the metal layers 92 (intermediate metal layers 42 to 45) illustrated in FIG. 5B, and the metal layer 93 (lowermost metal layer 46) illustrated in FIG. 5C are stacked. The metal layers 91 to 93 are pressed while heated to a given temperature (e.g., approximately 900° C.) to diffusion-bond the metal layers 91 to 93 (metal layers 41 to 46).

Then, the loop heat pipe 10, which is formed by the stack of the metal layers 41 to 46, is bent.

Figure 6A:
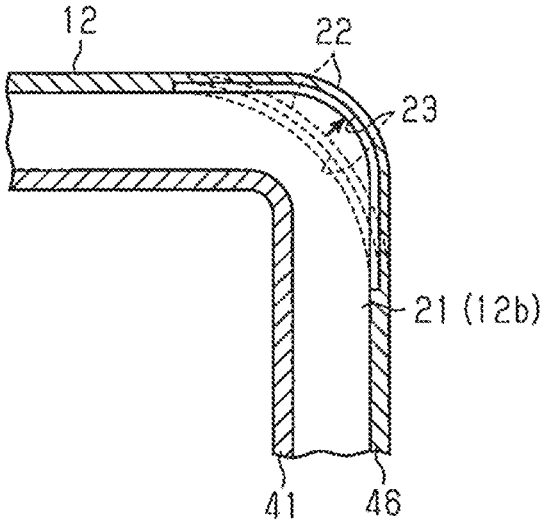
FIG. 6A is a schematic cross-sectional view of the vapor pipe in the embodiment illustrated in FIG. 1.
Figure 6B:
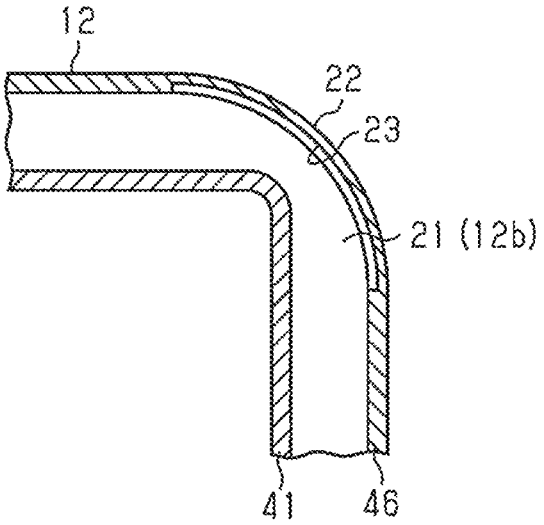
FIG. 6B is a schematic cross-sectional view of the vapor pipe before internal pressure is applied to a flow passage.

Referring to FIG. 6B, the loop heat pipe 10 is bent at the bending position BP illustrated in FIG. 1 so that the metal layer 46 including the thin wall portion 22 (recess 23) is arranged at the outer side. When the loop heat pipe 10 is bent at the bending position BP, both of the vapor pipe 12 and the liquid pipe 14 are bent at the bending position BP. In other words, a position at which the vapor pipe 12 is bent and a position at which the liquid pipe 14 is bent are aligned with the same bending line (bending position BP). The bending results in the tensile stress produced when bending the metal layer 46 (thin wall portion 22) of the vapor pipe 12 deforming the vapor pipe 12 inward and narrowing the flow passage 12*b* (flow passage 21) of the vapor pipe 12. The liquid pipe 14 is also bent in the same manner as the vapor pipe 12. However, the porous body 25 (refer to FIG. 4) functions as a support that reinforces the inside of the liquid pipe 14. Thus, the liquid pipe 14 resists squeezing. As a result, the liquid pipe 14 is subtly affected by deformation caused by the bending.

Then, the loop heat pipe 10 is filled with compressed air from the inlet 15 illustrated in FIG. 1 to apply internal pressure to the flow passage 21. The internal pressure is, for example, 0.7 to 1.0 MPa. In the present embodiment, the internal pressure is, for example, 1.0 MPa. As illustrated in FIG. 6A, the application of internal pressure to the flow passage 21 (thin wall portion 22 of vapor pipe 12) expands the thin wall portion 22 toward the outside of the vapor pipe 12. The expansion of the thin wall portion 22 ensures that the working fluid C (vapor Cv) smoothly flows in the flow passage 21 of the vapor pipe 12 and eases the flow of the vapor Cv.

The thin wall portion 22 (recess 23) is formed in a portion (bent portion) of the vapor pipe 12. Thus, the thickness of the outermost metal layer 46 is maintained at portions other than the thin wall portion 22. This limits deformation of the outermost metal layer 46 at portions other than the thin wall portion 22 when applying internal pressure to the flow passage 21. Further, the outermost metal layer 46 includes the recess 23 only in the flow passage 21 defined by the walls 42*a* to 45*a* of the intermediate metal layers 42 to 45. This keeps the working fluid C sealed in the vapor pipe 12 so that liquid does not leak out of the vapor pipe 12.

If the loop heat pipe 10 does not include the thin wall portion 22, for example, a large internal pressure would be needed when performing bending while applying internal pressure to the flow passage. In contrast, the loop heat pipe 10 of the present embodiment includes the thin wall portion 22 (recess 23). This allows the thin wall portion 22 to be expanded outward with a smaller internal pressure so as to form the flow passage 21*a* in a satisfactory manner at the bent portion.

Afterwards, a vacuum pump is used to discharge air out of the loop heat pipe 10. Then, the liquid pipe 14 is filled with the working fluid C (e.g., water) from the inlet 15. Then, the inlet 15 (sealed portion 15*b*) is sealed.

The mounting structure of the loop heat pipe 10 in accordance with the present embodiment will now be described with reference to FIGS. 1 and 7.

Referring to FIG. 7, the loop heat pipe 10 is used in, for example, an electronic device 100. The electronic device 100 will now be described.

The electronic device 100 includes a case 101, a wiring substrate 110 accommodated in the case 101, and the loop heat pipe 10. The wiring substrate 110 is held by a support (not illustrated) at a position separated from an inner surface 101*a* of the case 101. The electronic device 100 includes the heat-generating component 111 mounted on the upper surface of the wiring substrate 110. The heat-generating component 111 may be, for example, a semiconductor device such as a central processing unit (CPU) or a graphic processing unit (GPU).

The loop heat pipe 10 is bent to be L-shaped. The evaporator 11 is arranged on the heat-generating component 111 to cool the heat-generating component 111. The condenser 13 is arranged along a side plate 102 of the case 101 and fixed by a connection member 120 to the inner surface of the side plate 102. A heat sink may be used as the connection member 120. The condenser 13 is fixed to the side plate 102 to efficiently dissipate the heat generated by the heat-generating component 111 out of the case 101 through the loop heat pipe 10. A thermal interface material (TIM) may be arranged on the interface between the condenser 13 and the connection member 120, on the interface between the connection member 120 and the side plate 102, or on both of these interfaces. This will further smoothly transfer heat from the condenser 13 to the case 101.

The present embodiment has the advantages described below.

(1) The loop heat pipe 10 includes the evaporator 11, the vapor pipe 12, the condenser 13, the liquid pipe 14, and the inlet 15. The vapor pipe 12 includes the thin wall portion 22 at the bent portion (bending position BP). The loop heat pipe 10 is bent at the bending position BP so that the metal layer 46 including the thin wall portion 22 (the recess 23) is arranged at the outer side. The loop heat pipe 10 is then filled with compressed air from the inlet 15 to apply internal pressure to the flow passage 21. The internal pressure expands the thin wall portion 22 toward the outside of the vapor pipe 12. The arrangement of the thin wall portion 22 at the bent portion allows the thin wall portion 22 to be expanded outward with a lower internal pressure so that the flow passage 21 is formed in a satisfactory manner at the bent portion.

(2) The liquid pipe 14 is bent in the same manner as the vapor pipe 12. The liquid pipe 14 includes the porous body 25 (refer to FIG. 4). Accordingly, when the liquid pipe 14 is bent, the porous body 25 functions to reinforce the inside of the liquid pipe 14. Thus, the liquid pipe 14 resists squeezing. As a result, the liquid pipe 14 is subtly affected by deformation caused by the bending. The thin wall portion 22 (recess 23) only needs to be formed in the bent portion of the vapor pipe 12. This facilitates manufacturing of the loop heat pipe 10.

(3) The thin wall portion 22 (the recess 23) is formed in a portion (bent portion) of the vapor pipe 12. This maintains the thickness of the outermost metal layer 46 at portions other than the thin wall portion 22. Thus, when applying internal pressure to the flow passage 21, deformation of the outermost metal layer 46 is limited at portions other than the thin wall portion 22.

(4) The recess 23 in the outermost metal layer 46 is formed only in the flow passage 21 defined by the walls 42*a* to 45*a* of the intermediate metal layers 42 to 45. This keeps the working fluid C sealed in the vapor pipe 12 so that liquid does not leak out of the vapor pipe 12.

It should be apparent to those skilled in the art that the foregoing embodiments may be implemented in many other specific forms without departing from the scope of this disclosure. Particularly, it should be understood that the foregoing embodiments may be implemented in the following forms.

In the above embodiment, a single bending position BP is set. However, a plurality of bending positions BP may be set.

Figure 8A:
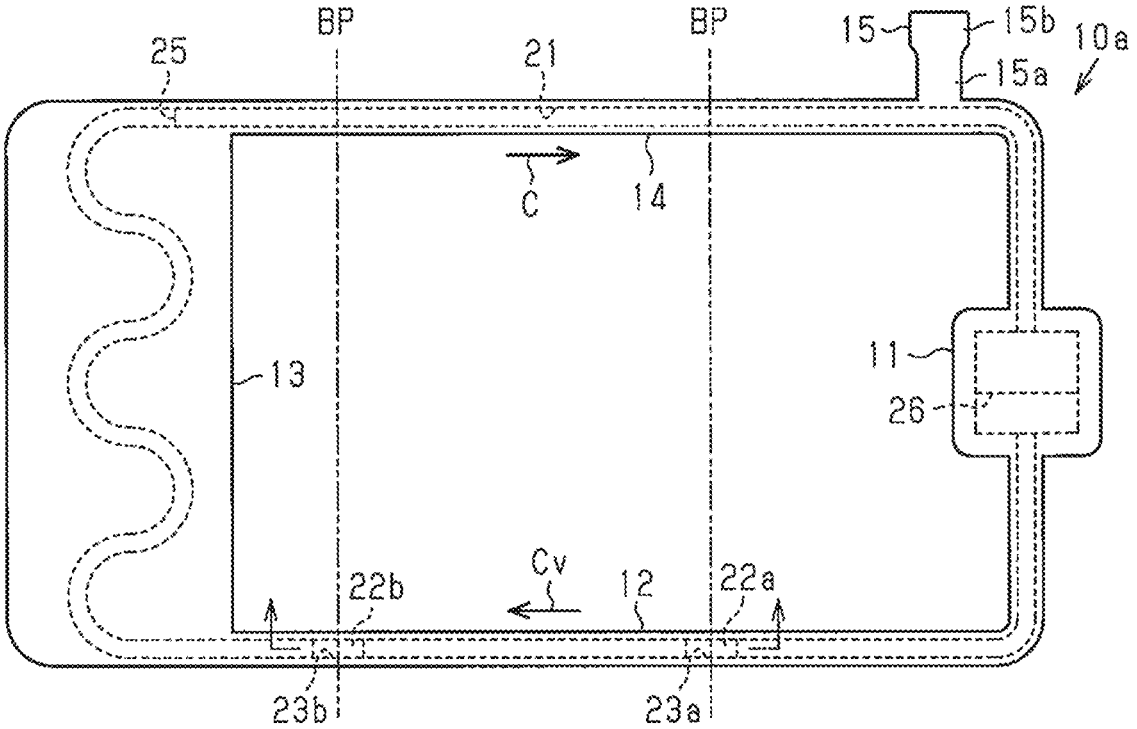
FIG. 8A is a schematic plan view illustrating a modified example of the loop heat pipe.
Figure 8B:
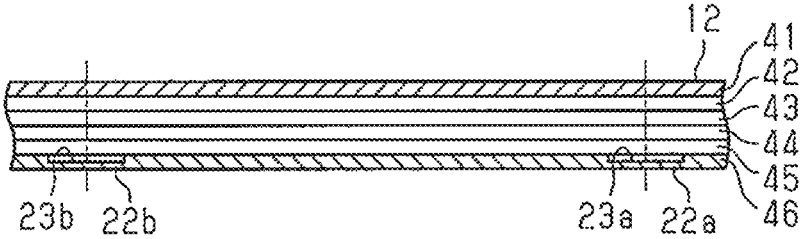
FIG. 8B is a schematic cross-sectional view of a liquid pipe in the loop heat pipe illustrated in FIG. 8A.
Figure 8C:
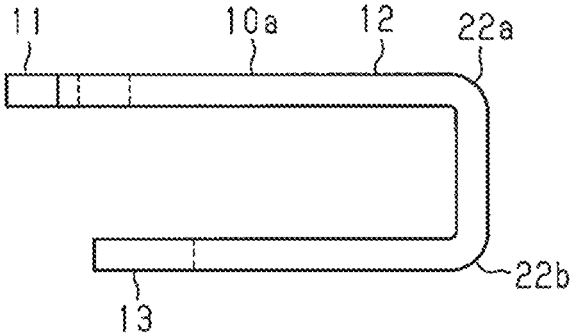
FIG. 8C is a schematic side view of the loop heat pipe illustrated in FIG. 8A after being bent.

FIG. 8A illustrates a modified example of a loop heat pipe 10*a* in which two bending positions BP are set. The vapor pipe 12 of the loop heat pipe 10*a* includes two thin wall portions 22*a* and 22*b* (recess 23*a* and 23*b*). As illustrated in FIG. 8B, the thin wall portions 22*a* and 22*b* (recess 23*a* and 23*b*) are formed in the outermost metal layer 46. As illustrated in FIG. 8C, the vapor pipe 12 is bent to be U-shaped with the thin wall portions 22*a* and 22*b* (outermost metal layer 46) each arranged at the outer side. After the bending, in the same manner as the above embodiment, the loop heat pipe 10*a* is filled with compressed air from the inlet 15 to apply internal pressure to the flow passage 21. In the same manner as the embodiment illustrated in FIG. 6A, the thin wall portions 22*a* and 22*b* are expanded toward the outer side so that the flow passage 21 is formed in a satisfactory manner at the bent portions (bending position BP).

Figure 9A:
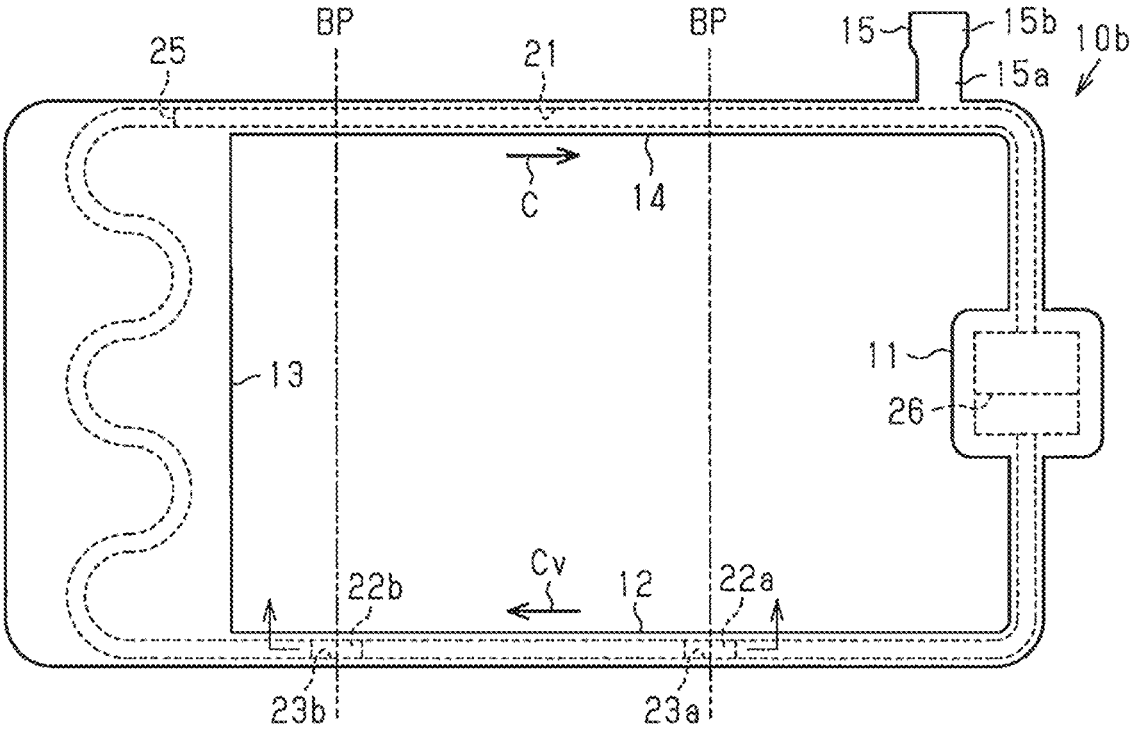
FIG. 9A is a schematic plan view illustrating another modified example of the loop heat pipe.
Figure 9B:
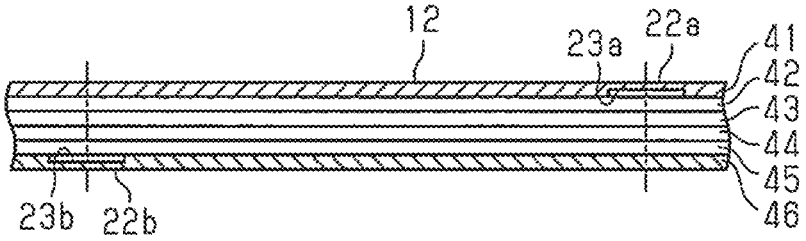
FIG. 9B is a schematic cross-sectional view of a liquid pipe in the loop heat pipe illustrated in FIG. 9A.
Figure 9C:
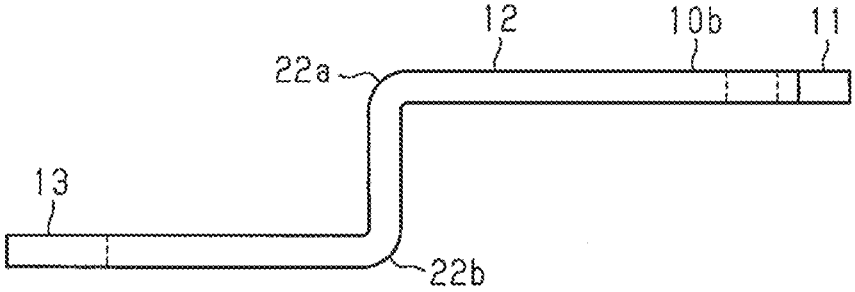
FIG. 9C is a schematic side view of the loop heat pipe illustrated in FIG. 9A after being bent.

FIG. 9A illustrates another modified example of a loop heat pipe 10*b* in which two bending positions BP are set. The vapor pipe 12 of the loop heat pipe 10*b* also includes the two thin wall portions 22*a* and 22*b* (recess 23*a* and 23*b*). As illustrated in FIG. 9B, the thin wall portion 22*a* (recess 23*a*) is formed in the outermost metal layer 41, and the thin wall portion 22*b* (recess 23*b*) is formed in the outermost metal layer 46. As illustrated in FIG. 9C, the vapor pipe 12 is bent to be crank-shaped with the thin wall portion 22*a* (outermost metal layer 41) and the thin wall portion 22*b* (outermost metal layer 46) each arranged at the outer side. After the bending, in the same manner as the above embodiment, the loop heat pipe 10*b* is filled with compressed air from the inlet 15 to apply internal pressure to the flow passage 21. In the same manner as the embodiment illustrated in FIG. 6A, the internal pressure expands the thin wall portions 22*a* and 22*b* toward the outer side so that the flow passage 21 is formed in a satisfactory manner at the bent portions (bending position BP).

Three or more bending positions BP may be set. In such a case, bending is performed three or more times.

In the above embodiment, the vapor pipe 12 and the liquid pipe 14 are bent. Instead, the condenser 13 may include a thin wall portion (recess), and the condenser 13 may be bent at the thin wall portion (recess).

In the above embodiment, the shape of the thin wall portion 22 (recess 23) may be changed.

Figure 10A:
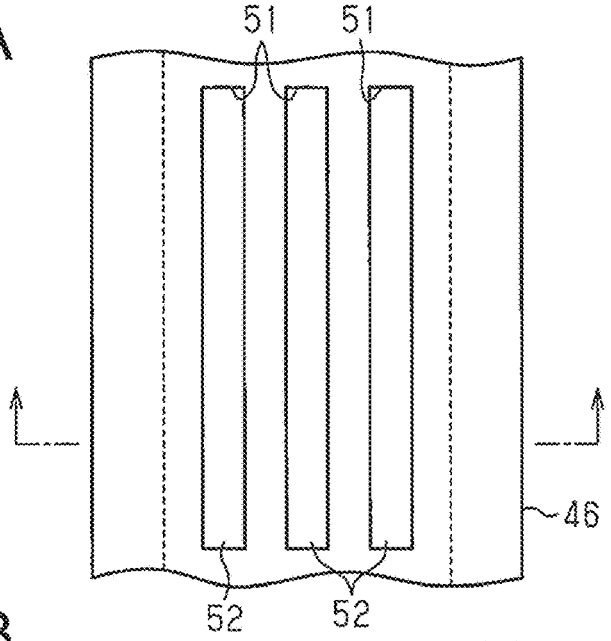
FIG. 10A is a partial plan view of a metal layer illustrating a thin wall portion in a modified example.
Figure 10B:
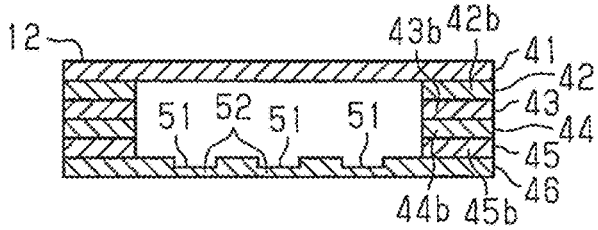
FIG. 10B is a schematic cross-sectional view of a liquid pipe using the metal layer (thin wall portion) of FIG. 10A.

FIGS. 10A and 10B illustrate thin wall portions 52 (recesses 51) in a modified example. As illustrated in FIG. 10A, the thin wall portions 52 (recesses 51) have the form of parallel strips extending in the direction in which the vapor Cv flows (vertical direction as viewed in FIG. 10A). In this structure, the thin wall portions 52 are formed so that the bent portion partially has a certain amount of thickness. This maintains the strength of the thin wall portions 52. Further, the recesses 51 have the form of strips extending in the flow direction of the working fluid C. This reduces pressure loss of the working fluid C. In this structure, the thin wall portions 52 (recesses 51) of the outermost metal layer 46 are also formed only in the flow passage defined by the walls 42*a* to 45*a* of the intermediate metal layers 42 to 45 (inner side of broken lines in FIG. 10A). This keeps the working fluid C sealed in the vapor pipe 12 so that liquid does not leak out.

Figure 11A:
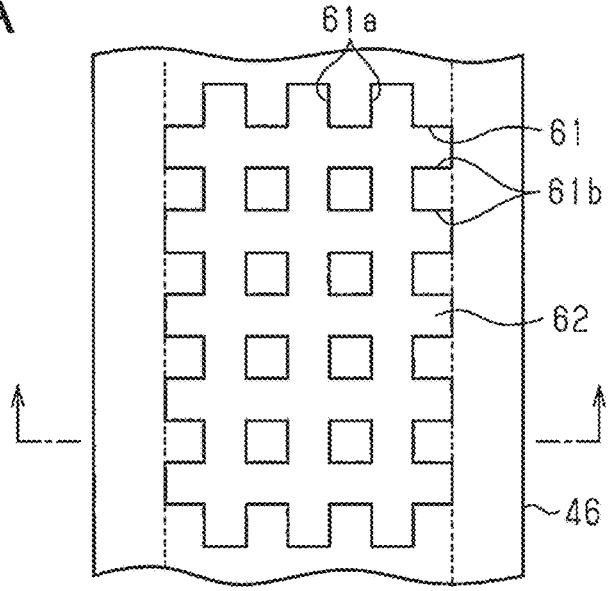
FIG. 11A is a partial plan view of a metal layer illustrating a thin wall portion in another modified example.
Figure 11B:
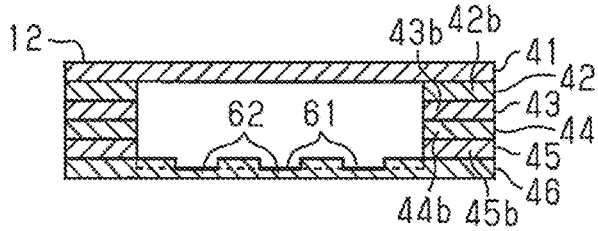
FIG. 11B is a schematic cross-sectional view of a liquid pipe using the metal layer (thin wall portion) of FIG. 11A.

FIGS. 11A and 11B illustrate a thin wall portion 62 (recess 61) in a further modified example. As illustrated in FIG. 11A, the thin wall portion 62 (recess 61) includes grooves 61*a* that extend in the direction in which the vapor Cv flows (vertical direction as viewed in FIG. 11A) and grooves 61*b* that extend in a direction perpendicular to the grooves 61*a*. Thus, the thin wall portion 62 (recess 61) has the form of a grid. In this structure, the thin wall portion 62 is also formed so that the bent portion partially has a certain amount of thickness. This maintains the strength of the thin wall portion 62. In this structure, the thin wall portion 62 (recess 61) of the outermost metal layer 46 is also formed only in the flow passage defined by the walls 42*a* to 45*a* of the intermediate metal layers 42 to 45 (inner side of broken lines in FIG. 11A). This keeps the working fluid C sealed in the vapor pipe 12 so that liquid does not leak out.

Figure 12A:
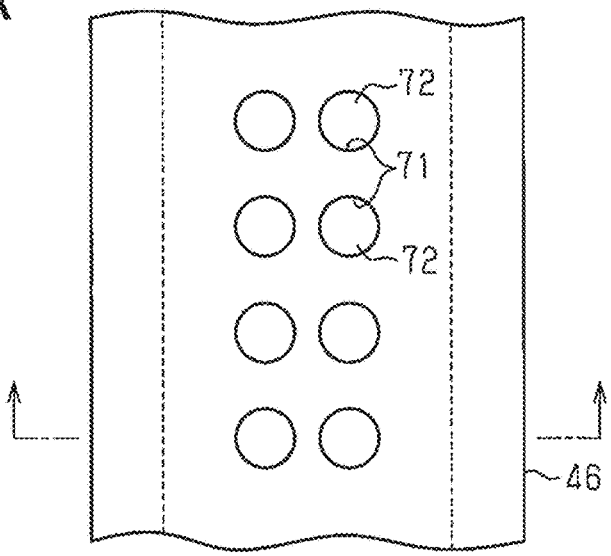
FIG. 12A is a partial plan view of a metal layer illustrating a thin wall portion in a further modified example.
Figure 12B:
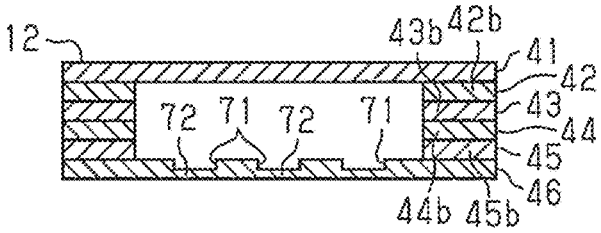
FIG. 12B is a schematic cross-sectional view of a liquid pipe using the metal layer (thin wall portion) of FIG. 12A.

FIGS. 12A and 12B illustrate thin wall portions 72 (recesses 71) in a further embodiment. As illustrated in FIG. 12A, the thin wall portions 72 (recesses 71) are arranged in rows. Each thin wall portion 72 (recess 71) is, for example, circular. However, the recesses 71 may be polygonal, for example, triangular or quadrangular. Further, the recesses 71 do not have to be arranged in rows. In this structure, the thin wall portions 72 are also formed so that the bent portion partially has a certain amount of thickness. This maintains the strength of the thin wall portions 72. Further, in this structure, the thin wall portions 72 (recesses 71) of the outermost metal layer 46 are also formed only in the flow passage defined by the walls 42*a* to 45*a* of the intermediate metal layers 42 to 45 (inner side of broken lines in FIG. 12A). This keeps the working fluid C sealed in the vapor pipe 12 so that liquid does not leak out.

Figure 13A:
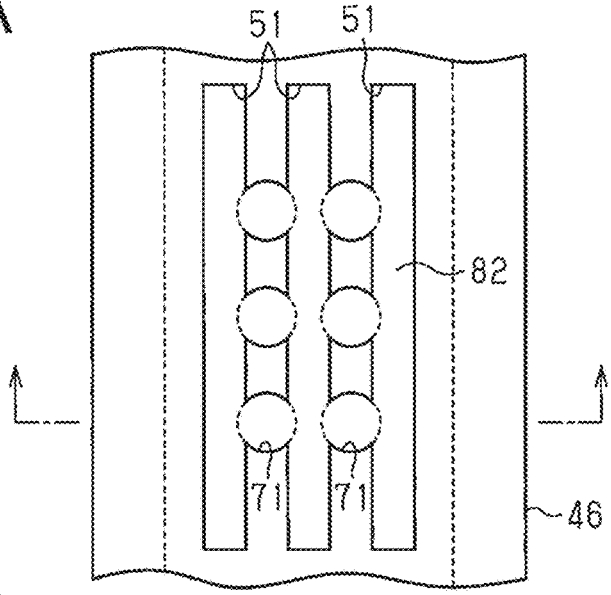
FIG. 13A is a partial plan view of a metal layer illustrating a thin wall portion in a further modified example.
Figure 13B:
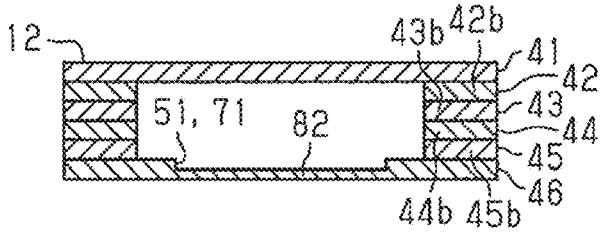
FIG. 13B is a schematic cross-sectional view of a liquid pipe using the metal layer (thin wall portion) of FIG. 13A.

FIGS. 13A and 13B illustrate thin wall portions 82 in a further embodiment. As illustrated in FIG. 13A, the thin wall portions 82 are formed by combining strips of recesses 51 with circular recesses 71. In this structure, the thin wall portions 82 are also formed so that the bent portion has a certain amount of thickness. This maintains the strength of the thin wall portions 82. Further, in this structure, the thin wall portions 82 (recesses 51 and 71) of the outermost metal layer 46 are formed only in the walls 42*a* to 45*a* of the intermediate metal layers 42 to 45 (inner side of broken lines in FIG. 13A). This keeps the working fluid C sealed in the vapor pipe 12 so that liquid does not leak out.

In the above embodiment and modified examples, a thin wall portion is formed by a recess at the inner side of the loop heat pipe 10. For example, in the embodiment of FIG. 2A, the thin wall portion 22 is formed by the recess 23 in the upper surface of the metal layer 46. Instead, the recess may be formed at the outer side of the loop heat pipe 10. For example, in the embodiment of FIG. 2A, the thin wall portion 22 may be formed by a recess 23 in the lower surface of the metal layer 46. In this manner, as long as the thin wall portion 22 can be formed by reducing the thickness of part of the metal layer 46, the thin wall portion 22 may be formed through any method.

Parts of the above embodiment and the modified examples may be replaced by known structures. Further, the above embodiment and the modified examples may be partially or entirely combined with other embodiments or modified examples.

CLAUSES

This disclosure further encompasses the following embodiments.

1. A method for manufacturing a loop heat pipe, the method including:

forming a metal layer stack by stacking a plurality of intermediate metal layers between two outermost metal layers, wherein the metal layer stack includes an evaporator that vaporizes working fluid, a condenser that liquefies the working fluid vaporized by the evaporator, a vapor pipe that sends the working fluid vaporized by the evaporator to the condenser, a liquid pipe that sends the working fluid liquefied by the condenser to the evaporator, and an inlet that fills the loop heat pipe with the working fluid, wherein at least one of the two outermost metal layers includes a thin wall portion that forms a portion of a wall of the vapor pipe;

bending the loop heat pipe at a position of the thin wall portion with the thin wall portion arranged at an outer side;

expanding the thin wall portion toward an outside of the wall of the vapor pipe by filling the loop heat pipe with compressed air from the inlet and applying internal pressure to the thin wall portion; and hermetically sealing the inlet after filling the loop heat pipe with the working fluid from the inlet.

2. The method according to clause 1, wherein the forming a metal layer stack includes forming a porous body in the liquid pipe by stacking the intermediate metal layers, and the bending the loop heat pipe includes bending the loop heat pipe at one or more bending positions so that both of the vapor pipe and the liquid pipe are bent at each of the one or more bending positions.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to an illustration of the superiority and inferiority of the invention. Although embodiments have been described in detail, it should be understood that various changes, substitutions, and alterations could be made hereto without departing from the scope of this disclosure.

The invention claimed is:

1. A loop heat pipe comprising:

a metal layer stack of two outermost metal layers and a plurality of intermediate metal layers stacked between the two outermost metal layers, wherein the metal layer stack includes an evaporator that vaporizes working fluid, a condenser that liquefies the working fluid vaporized by the evaporator, a vapor pipe that sends the working fluid vaporized by the evaporator to the condenser, a liquid pipe that sends the working fluid liquefied by the condenser to the evaporator, and an inlet that fills the loop heat pipe with the working fluid, wherein the metal layer stack forms a looped flow passage that circulates the working fluid through the evaporator, the vapor pipe, the condenser, and the liquid pipe, wherein at least one outermost metal layer of the two outermost metal layers includes, at a location of the vapor pipe, a thinner wall portion that is thinner than the at least one outermost metal layer and that forms a portion of a wall of the vapor pipe in the looped flow passage, wherein the vapor pipe includes only one single vapor flow passage that forms a portion of the looped flow passage, and wherein an entirety of the thinner wall portion is exposed inside the single vapor flow passage.

2. The loop heat pipe according to claim 1, wherein the vapor pipe is bent at a position of the thinner wall portion with the thinner wall portion arranged at an outer side of the vapor pipe.

3. The loop heat pipe according to claim 1, wherein the at least one outermost metal layer includes, at the location of the vapor pipe, a recess that opens into the looped flow passage, wherein the recess defines the thinner wall portion of the vapor pipe.

4. The loop heat pipe according to claim 3, wherein the recess is uniformly hollowed over a width of the vapor pipe.

5. The loop heat pipe according to claim 3, wherein the recess is one of a plurality of recesses having the form of parallel strips extending in a direction in which the working fluid flows.

6. The loop heat pipe according to claim 3, wherein the recess has the form of a grid and includes a first groove extending in a direction in which the working fluid flows and a second groove extending in a direction perpendicular to the first groove.

7. The loop heat pipe according to claim 3, wherein the recess is circular or polygonal.

8. The loop heat pipe according to claim 2, wherein the liquid pipe includes a porous body formed by the intermediate metal layers, and the loop heat pipe is bent at one or more bending positions so that both of the vapor pipe and the liquid pipe are bent at each of the one or more bending positions.

9. A loop heat pipe comprising:

a metal layer stack of two outermost metal layers and a plurality of intermediate metal layers stacked between the two outermost metal layers, wherein the metal layer stack includes an evaporator that vaporizes working fluid, a condenser that liquefies the working fluid vaporized by the evaporator, a vapor pipe that sends the working fluid vaporized by the evaporator to the condenser, a liquid pipe that sends the working fluid liquefied by the condenser to the evaporator, and an inlet that fills the loop heat pipe with the working fluid, wherein the metal layer stack forms a looped flow passage that circulates the working fluid through the evaporator, the vapor pipe, the condenser, and the liquid pipe, wherein at least one outermost metal layer of the two outermost metal layers includes a wall portion that forms a portion of a wall of the vapor pipe in the looped flow passage, wherein the at least one outermost metal layer includes a first surface that faces the looped flow passage and a second surface opposite the first surface, wherein the wall portion includes a recess formed in one of but not both of the first surface and the second surface, wherein the vapor pipe includes only one single vapor flow passage that forms a portion of the looped flow passage, and wherein an entirety of the recess is exposed inside the single vapor flow passage.

10. The loop heat pipe according to claim 9, wherein the vapor pipe is bent at a position of the wall portion with the wall portion arranged at an outer side of the vapor pipe.

11. The loop heat pipe according to claim 9, wherein the recess is uniformly hollowed over a width of the vapor pipe.

12. The loop heat pipe according to claim 9, wherein the recess is one of a plurality of recesses having the form of parallel strips extending in a direction in which the working fluid flows.

13. The loop heat pipe according to claim 9, wherein the recess has the form of a grid and includes a first groove extending in a direction in which the working fluid flows and a second groove extending in a direction perpendicular to the first groove.

14. The loop heat pipe according to claim 9, wherein the recess is circular or polygonal.

15. The loop heat pipe according to claim 9, wherein the liquid pipe includes a porous body formed by the intermediate metal layers, and the loop heat pipe is bent at one or more bending positions so that both of the vapor pipe and the liquid pipe are bent at each of the one or more bending positions.

16. The loop heat pipe according to claim 1, wherein the thinner wall portion does not extend to the liquid pipe.

17. A loop heat pipe comprising:

a metal layer stack of two outermost metal layers and a plurality of intermediate metal layers stacked between the two outermost metal layers, wherein the metal layer stack includes an evaporator that vaporizes working fluid, a condenser that liquefies the working fluid vaporized by the evaporator, a vapor pipe that sends the working fluid vaporized by the evaporator to the condenser, a liquid pipe that sends the working fluid liquefied by the condenser to the evaporator, and an inlet that fills the loop heat pipe with the working fluid, wherein the metal layer stack forms a looped flow passage that circulates the working fluid through the evaporator, the vapor pipe, the condenser, and the liquid pipe, wherein at least one outermost metal layer of the two outermost metal layers includes a thinner wall portion that is thinner than the at least one outermost metal layer over an entire width of the vapor pipe, wherein the vapor pipe includes only one single vapor flow passage that forms a portion of the looped flow passage, and wherein an entirety of the thinner wall portion is exposed inside the single vapor flow passage.

18. The loop heat pipe according to claim 17, wherein the at least one outermost metal layer includes, at a location of the vapor pipe, the thinner wall portion.

19. The loop heat pipe according to claim 1, wherein the thinner wall portion extends along the loop heat pipe over at least one-tenth of a length of the one or more bending positions.

20. The loop heat pipe according to claim 1, wherein the thinner wall portion extends along the loop heat pipe over at least a majority of a length of the one or more bending positions.

* * * * *